United States Patent [19]

Wilcox

[11] Patent Number: 4,601,145

[45] Date of Patent: Jul. 22, 1986

[54] ADJUSTABLE ROOM PARTITION

[76] Inventor: Roger Wilcox, 56862 Inwood Ct., Elkhart, Ind. 46516

[21] Appl. No.: 762,630

[22] Filed: Aug. 5, 1985

[51] Int. Cl.[4] ..... E04B 1/343; A47G 5/00

[52] U.S. Cl. ..... 52/238.1; 52/36; 52/239; 160/135; 160/351

[58] Field of Search ..... 52/239, 238.1, 36; 160/135, 351

[56] References Cited

U.S. PATENT DOCUMENTS 3,762,116 10/1973 Anderson et al. ..... 52/239

3,971,182 7/1976 Donahue et al. ..... 52/239 X 4,021,973 5/1977 Hegg et al. ..... 52/36

4,104,838 8/1978 Hage et al. ..... 52/239

4,416,093 11/1983 Salkeld et al. ..... 52/238.1

*Primary Examiner*—J. Karl Bell

*Attorney, Agent, or Firm*—Thomas J. Dodd

[57] ABSTRACT

An adjustable room partition which includes individual partitions secured by hooks to a common post. A removable clamp having peripheral notches accepts and secures the hooks and serves to hold the partitions in a selected angular orientation.

3 Claims, 8 Drawing Figures

ADJUSTABLE ROOM PARTITION

SUMMARY OF THE INVENTION

This invention relates to a partition and will have application to room partitions which may be radially adjusted.

Room partitions are useful, inexpensive articles used primarily to divide a large working area into a plurality of smaller private work areas. The assembly of the previously known partitions was not only time consuming and difficult but also highly inflexible in that radial adjustment of adjacent partitions could not be achieved without completely disconnecting one partition from an adjacent partition.

The partitions of this invention include a hook connection which permits more convenient and economical initial assembly and permits rapid subsequent radial adjustment of the partitions. A notched clamp secures the partitions in a selected position and is readily removable to permit rapid subsequent partition adjustment without complete removal of the hook connections.

Accordingly, it is an object of this invention to provide for a novel room partition.

Another object of this invention is to provide for a portable, radially adjustable room partition.

Another object of this invention is to provide for a room partition which is efficient and economical.

Another object of this invention is to provide for a room partition which is easily assembled and disassembled.

BRIEF DESCRIPTION OF THE DRAWINGS

A preferred embodiment of the invention has been depicted for purposes of illustration wherein.

DESCRIPTION OF THE PREFERRED EMBODIMENT

Figure 1:
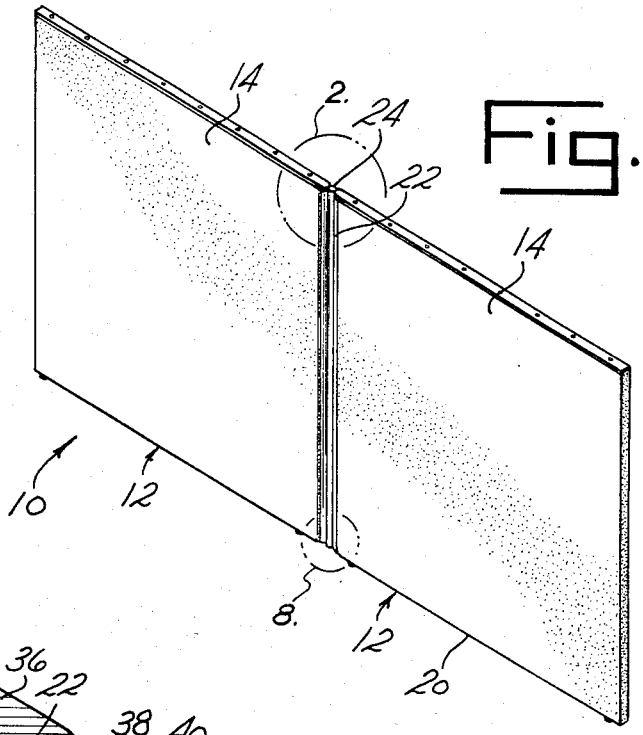
FIG. 1 is a top perspective view of two room partitions constructed according to the principles of this invention, with the partitions shown in a generally coplanar orientation.

The preferred embodiment herein described is not intended to be exhaustive or to limit the invention to the precise form disclosed. It is chosen and described to explain the principles of the invention and its application and practical use to enable others skilled in the art to utilize the invention.

The drawings illustrate an embodiment wherein adjacent partitions are adjustable in five different positions relative to each other. For example, viewing along the top edge from one partition to the other, the second partition can be fixed, in a counter-clockwise mode, progressively at angles of from 90°, to 135°, to 180° ( or, coplanar), to 225° and finally to 270° and it should be understood that this is by way of illustration only. Without the disk, each adjacent partition, with hooks in place, is free to rotate about the post between them. The disk may be notched other than as illustrated in order to permit freedom of design. By way of further example, the notches may be spaced 60° apart or at any desired angle. One could thereby create rooms having from four to five to six, etc., sides, or a variety of shapes limited only by one's imagination and creativity. This was not previously achievable except by great effort and expense.

Partition 10 shown in the drawings includes a plurality of individual partition members 12 (two shown), each of which has opposite side faces 14,16, top edge 18, bottom edge 20, and end caps 22 secured to partition member 12 by screws 21. Partition members 12 are preferably formed of rigid, durable material such as rigid PVC with faces 14,16 covered by a fabric or cloth material.

Figure 2:
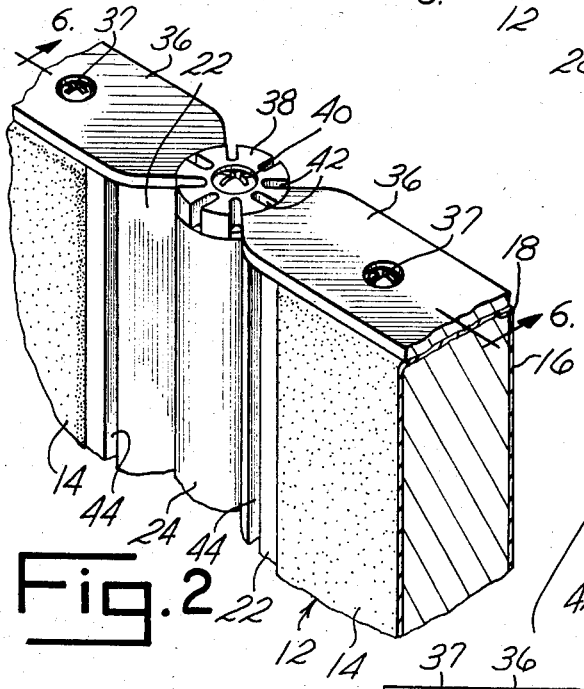
FIG. 2 is a fragmentary top perspective view of the partitions within the circle 2 of FIG. 1.
Figure 3:
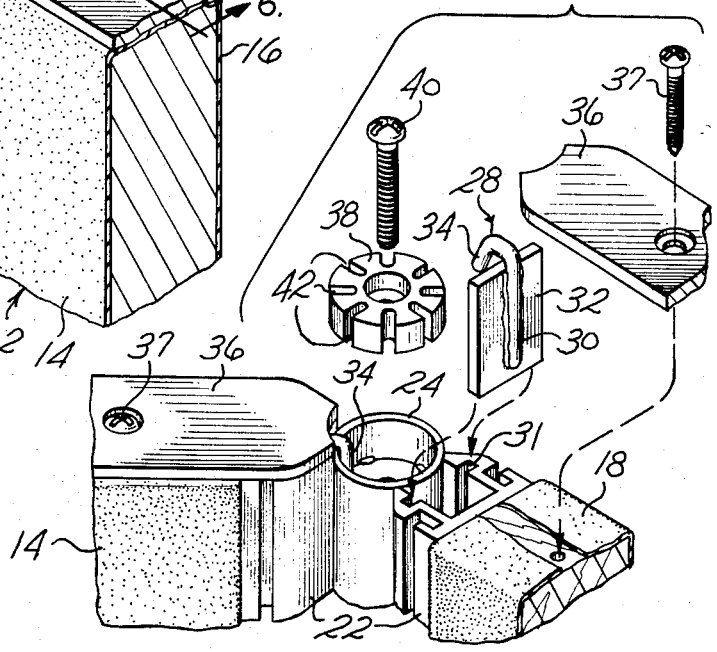
FIG. 3 is an exploded view of the partitions of FIG. 2.
Figure 4:
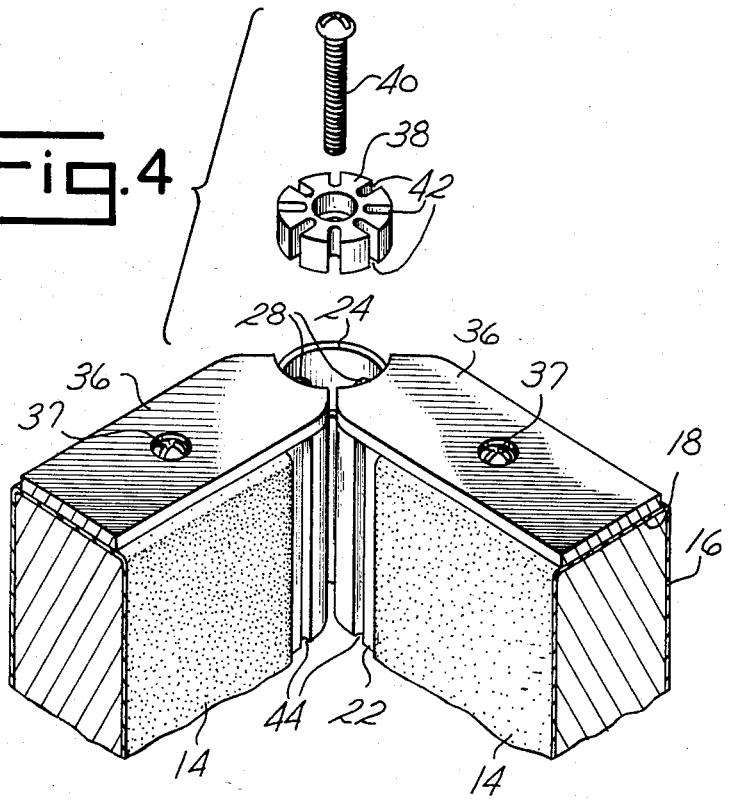
FIG. 4 is fragmentary exploded top view of the partitions showing the partitions in a perpendicular orientation.
Figure 5:
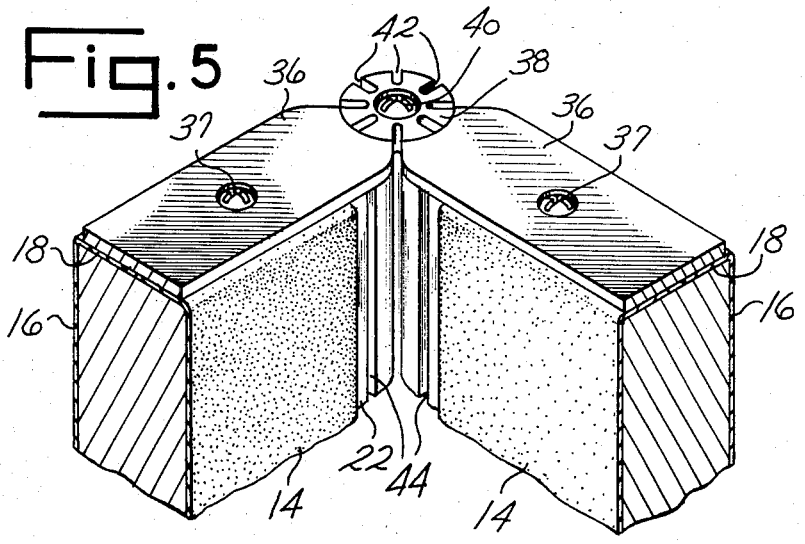
FIG. 5 is a fragmentary perspective view of the partitions of FIG. 4.
Figure 6:
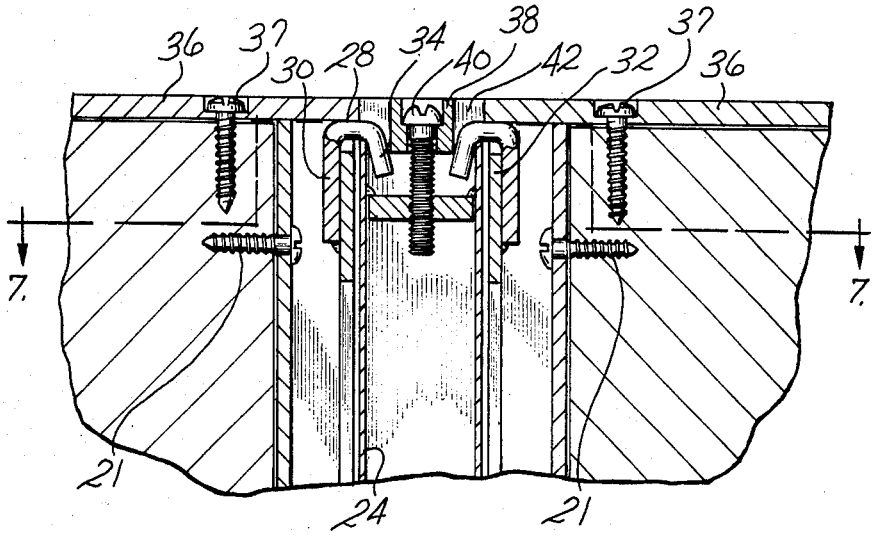
FIG. 6 is a fragmentary sectional view taken along line 6—6 of FIG. 2.
Figure 7:
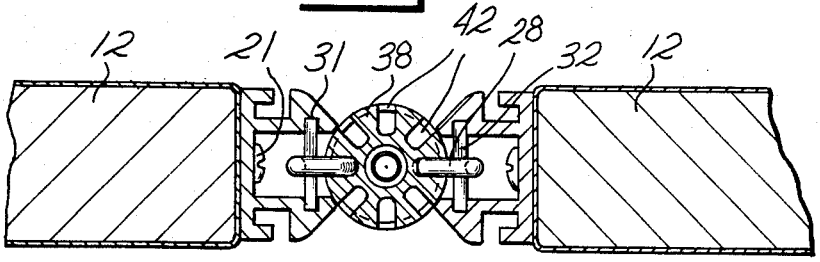
FIG. 7 is a fragmentary cross-sectional view taken along line 7—7 of FIG. 6.
Figure 8:
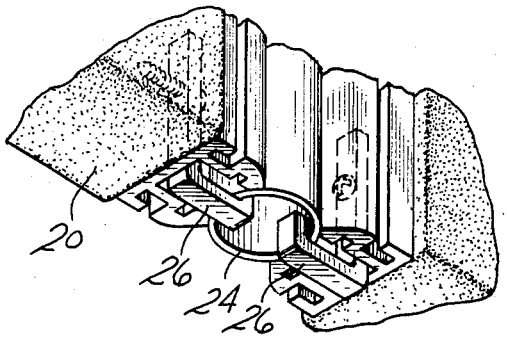
FIG. 8 is a fragmentary bottom perspective view of the area within circle 8 of FIG. 1.

Positioned between member end caps 22 is a post 24 preferably formed of rigid tubular material. A hook 28 includes an anchor part 30 connected to a plate 32 which is fitted within vertical slot 31 of the end cap 22 as shown in FIG. 3. Hook 28 also includes integral return bent part 34 shaped so to fit over post 24. A cap 36 overlies member top edge 18 and hook anchor part 30 to further secure the hook 28. Cap 36 is secured to top edge 18 by screws 37. A hook 26 is utilized at the bottom edge of end caps 22 to secure partition members 12 to post 24. Constructed in this fashion, each partition member 12 is radially shiftable about post 24 between the coplanar orientation of FIGS. 1 and 2 and the perpendicular orientation of FIGS. 4 and 5.

A clamping disk 38 is fastened to post 24 adjacent member top edge 18 by a fastener 40. Disk 38 includes notches 42 generally equally spaced about its periphery, which accept and secure hook return bent part 34 in a selected position thereby establishing the spatial relationship between partition members 12. It will be understood that, while disk 38 is shown having grooves or notches spaced 45° apart, all that is needed for different relationships or angles between adjacent partitions is a set of disks with differently spaced notches. Each partition member 12 may include a vertical groove 44 in each end cap 22 to facillitate securement of horizontal shelves (not shown).

To adjust partition members 12, fastener 40 is loosened and clamping disk 38 raised until hook return bent part 34 is free of disk notches 42. Member 12 is then radially adjusted about post 24 into the desired position and disk 38 lowered until hook part 34 is confined within another disk notch 42. Fastener 40 is then turned to secure the disk in this position.

It is to be understood that the invention is not limited to the above description but may be modified within the scope of the appended claims.

I claim:

1. A room partition comprising a plurality of partition members, each partition member including spaced end edges and top and bottom edges, one of said end edges positioned adjacent an end edge of a second partition member, a post positioned between said partition member adjacent end edges, a hook secured to each partition member at one of said top and bottom edges, and said hooks constituting means for rotatably securing said partition members to said post wherein said partition members are shiftable between a multiplicity of positions and a cap member removably secured to one of said post top and bottom edges, said cap member constituting means for securing said partition members in one of said multiplicity of positions, said cap member including peripheral notches, said notches for accepting and securing said hooks and partition members between one of its said multiplicity of positions.

2. The room partition of claim 1 wherein said partition member includes an end cap having a vertical slot, said hook having one end secured to a plate fitted within said slot, said hook including a return bent portion from said hook one end fitted within said post, and a cap secured to said partition member at one of said top and bottom edges, each cap overlying and securing said hook one end within said slot.

3. The room partition of claim 1 wherein each partition member includes first and second faces, a groove cut in one of said partition member first and second faces.

* * * * *